US005592178A

United States Patent [19]

Chang et al.

[11] Patent Number: 5,592,178

[45] Date of Patent: Jan. 7, 1997

[54] WIDEBAND INTERFERENCE SUPPRESSOR IN A PHASED ARRAY RADAR

[75] Inventors: Kaichiang Chang, Northborough; Fernando Beltran, Framingham; Fritz Steudel, Sudbury, all of Mass.

[73] Assignee: Raytheon Company, Lexington, Mass.

[21] Appl. No.: 252,502

[22] Filed: Jun. 1, 1994

[51] Int. Cl.[6] ..... H01Q 3/22

[52] U.S. Cl. ..... 342/372; 342/154; 342/81; 342/368

[58] Field of Search ..... 342/154, 378, 342/375, 372, 81, 368

[56] References Cited

U.S. PATENT DOCUMENTS

| | | | |
|---|---|---|---|
| 3,763,490 | 10/1973 | Hadley et al. | 343/100 SA |
| 4,017,867 | 4/1977 | Claus | 343/854 |
| 4,336,543 | 6/1982 | Ganz et al. | 343/705 |
| 4,489,324 | 12/1984 | Blume | 343/372 |
| 4,495,502 | 1/1985 | Masak | 343/388 |
| 4,516,126 | 5/1985 | Masak et al. | 343/383 |
| 4,736,460 | 4/1988 | Rilling | 455/283 |
| 4,872,016 | 10/1989 | Kress | 342/380 |
| 4,937,584 | 6/1990 | Gabriel et al. | 342/378 |
| 5,103,232 | 4/1992 | Chang et al. | 342/372 |

OTHER PUBLICATIONS

"Optimizing the Synthesis of Shaped Beam Antenna Patterns," H. J. Orchard, R. S. Elliott, G. J. Stern, IEEE Proceedings (London), Pt. H., 1 (1985), pp. 63–68.

"Pattern Synthesis Based on Adaptive Array Theory," E. C. Dufort, IEEE Transactions on Antennas and Propagation, vol. 37, No. 8, Aug. 1989, pp. 1011–1018.

*Primary Examiner*—Thomas H. Tarcza
*Assistant Examiner*—Dao L. Phan
*Attorney, Agent, or Firm*—Donald F. Mofford

[57] ABSTRACT

A phased array radar antenna uses time-steering subarray notch weightings to produce a wideband notch in the direction of interference for Electronic-Counter-Measure (ECM) interference suppression. A predetermined set of subarray notch weightings, each set being identical for each subarray, is stored in controllers each of which is coupled to a plurality of phase shifters and attenuators for feeding radiating elements of the antenna. Interference suppressors operate from a plurality of controllers to produce a subarray pattern having a notch in the direction of interference. Beamformers then combine outputs of all time-steering subarrays in the antenna so as to produce an antenna pattern having a wideband notch in the direction of interference.

20 Claims, 10 Drawing Sheets

WIDEBAND INTERFERENCE SUPPRESSOR IN A PHASED ARRAY RADAR

The Government has rights in this invention pursuant to Contract No. DASG60-92-C-0194 awarded by the Department of the Army.

BACKGROUND OF THE INVENTION

This invention relates to a phased array radar and in particular to an apparatus and method for providing wideband interference suppression using subarray weighting to produce an array pattern having a notch in the direction of the interference.

Military radars must operate in a hostile environment, where they may be subjected to deliberate interference designed to degrade their performance. To suppress such ECM (Electronic-Counter-Measure) interference in a typical solid state phased array radar, a predetermined complex weight in terms of amplitude and phase is applied to each transmit/receive (T/R) module at the element level, so as to produce an array pattern having a notch in the direction of the interference. Such an interference suppressor uses a simple open-loop scheme which has no expensive real-time processor for interference suppression. However, it needs to know the direction of the interference which usually is given in most ECM threat scenarios.

In U.S. Pat. No. 4,872,016, entitled "Data Processing System For A Phased Array Antenna," issued Oct. 3, 1989, to Robert W. Kress, and assigned to Grumman Aerospace Corporation, it is pointed out that interference suppression is obtained in a phased array antenna system by generating nulls in the receive antenna pattern in the direction of the interference. The nulls are produced by adjusting the phase and amplitude (weight) of the received signal from each array element just enough to null the interference with minimal impact on the rest of the antenna pattern. This patent for interference suppression uses a close-loop microwave hardware and expensive data processors for real-time processing. As a result, its degrees of freedom is significantly limited by the number of array elements and the data processing load.

Conventional open-loop interference suppression algorithms generate complex weightings using full-aperture, element-level notching. A typical narrowband notched pattern using this method (designed to have −55 dB notch level) is shown in FIG. 5. For wideband operation, the typical solid state phased array is designed to use phase steer at the element level and time delay steer at the subarray level. For array scans off boresight, this results in correlated phase errors at frequencies offset from the center frequency of the wideband waveform. The phase slope within each subarray at frequencies either higher or lower than the center frequency is different from that at the center frequency. This is due to the phase steering at the element level. As a result of these correlated phase errors, high quantization lobes are produced in the notch section at the offset frequencies. (At center frequency the pattern is identical to the full aperture notched pattern of FIG. 5). By averaging the antenna patterns across the wideband waveform, a wideband notch level of −42 dB is obtained (FIG. 6) and is degraded by 13 dB as compared to the narrowband notch level of −55 dB (FIG. 5).

Using a beamformer architecture as shown in FIG. 4 (for monopulse operation), the sum beam is formed using Taylor weighting at the element level with a uniform combiner. Simultaneously, a Bayliss difference beam is formed using the same Taylor weighting at the element level together with a Bayliss/Taylor non-uniform combiner. The resultant monopulse patterns are shown in FIG. 7. If using narrowband notch weights per the conventional algorithm (full aperture notching), the sum beam exhibits a good notched pattern, but the difference beam is significantly degraded in terms of notch degradation, high angular errors, and decreased monopulse slope. This occurs even at mid-band and is illustrated in FIG. 8.

This invention is directed at providing full recovery of notch integrity for wideband interference suppression by using subarray weighting with minimal impact to the monopulse antenna patterns of the sum and difference beams for precision tracking.

SUMMARY OF THE INVENTION

Accordingly, it is therefore an object of this invention to provide a phased array antenna using time-steering subarray notch weightings to produce a wideband notch in the direction of interference.

It is a further object of this invention to provide a phased array antenna with wideband interference suppression using an identical set of subarray notching weights of phase shift and attenuation for each of the subarrays.

The objects are further accomplished by providing a phased array antenna comprising a plurality of time-steering subarrays, each of the subarrays comprises a plurality of interference suppressor means, the interference suppressor means comprises means for generating a set of identical notch control commands for each of the time-steering subarrays, subarray driver means coupled to each of the time-steering subarrays for combining outputs of the interference suppressor means to produce an identical notch for each of the subarrays in the direction of interference; and beamforming means coupled to the subarray driver means for combining outputs of the time-steering subarrays to produce a wideband notch of the antenna in the direction of interference. Each of the time-steering subarrays comprises a plurality of radiating elements. Each of the time-steering subarrays comprises a subarray combiner means for time-steering a direction of a corresponding beam of electromagnetic energy of the antenna for wideband operation. The means for generating a set of identical notch control commands comprises means for storing a predetermined set of subarray notch weightings. Each of the subarray notch weightings comprises a phase shift term and an attenuation term. The interference suppressor means operates within a processing means coupled to phase shift means and attenuation means for each radiating element of the subarrays.

The objects are further accomplished by providing a phased array antenna having a wideband interference suppression comprising a plurality of subarrays, each of the subarrays comprises a plurality of radiating elements, subarray combiner means coupled to each of the plurality of subarrays for providing an azimuth difference beam, an elevation difference beam, and a sum beam for precision tracking of monopulse operation, subarray driver means, including time delay unit means, coupled to the corresponding subarray combiner means, for time-steering a direction of a corresponding beam of electromagnetic energy of the antenna for wideband operation, phase shift means coupled to each of the radiating elements for phase-steering the direction of the beam of electromagnetic energy and controlling a spatial distribution of the electromagnetic energy of the antenna, attenuation means coupled to each of the phase shift means for adjusting the gain of each of the plurality of radiating elements and controlling the spatial distribution of the electromagnetic energy of the antenna, processing means coupled to the phase shift means and the attenuation means for providing an interference suppressor means for the radiating elements of the subarrays, the processing means comprises means for storing a predetermined set of subarray notch weightings, the predetermined set of subarray notch weightings being identical for each subarray, the interference suppressor means comprises means for generating a phase shift command and an attenuation command for each of the radiating elements in accordance with the subarray notch weightings, the time delay unit means comprises means for combining outputs of the subarray radiating elements in accordance with the phase shift command and the attenuation command to produce the spatial distribution of the electromagnetic energy of each of the subarrays having an identical notch in the direction of interference for each of the subarrays, and beamforming means coupled to the time delay unit means for combining outputs of the subarray driver means, each of the subarrays producing the identical notch in the direction of interference, and for producing the spatial distribution of the electromagnetic energy of the antenna having a wideband notch in the direction of interference. Each of the subarray notch weightings comprises a phase shift term and an attenuation term. The subarray driver means comprises a time delay unit for each of the azimuth difference beam, the elevation difference beam and the sum beam. The processing means comprises an output controller for generating transmit and receive control signals, providing external control data, storing the phase shift command and attenuation command outputs, and providing BITE operations.

The objects are further accomplished by a method for providing interference suppression in a phased array antenna comprising the steps of providing a plurality of time-steering subarrays, providing a plurality of interference suppressor means for the subarrays generating a set of identical notch control commands for each of the time-steering subarrays with the interference suppressor means, combining outputs of the interference suppressor means with subarray driver means coupled to each of the time-steering subarrays to produce an identical notch for each of the subarrays, and combining outputs of the time-steering subarrays to produce a wideband notch of the antenna in the direction of interference beamforming means coupled to the subarray driver means. The step of providing a plurality of time-steering subarrays comprises the step of each of the time-steering subarrays having a plurality of radiating elements. The step of providing the time-steering subarrays comprises the step of providing a subarray combiner means for time-steering a direction of a corresponding beam of electromagnetic energy of the antenna for wideband operation. The step of generating a set of identical notch control commands comprises the step of storing a predetermined set of subarray notch weightings. The step of storing the predetermined set of the subarray notch weightings comprises the step of storing a phase shift term and an attenuation term for each of the notch weightings.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
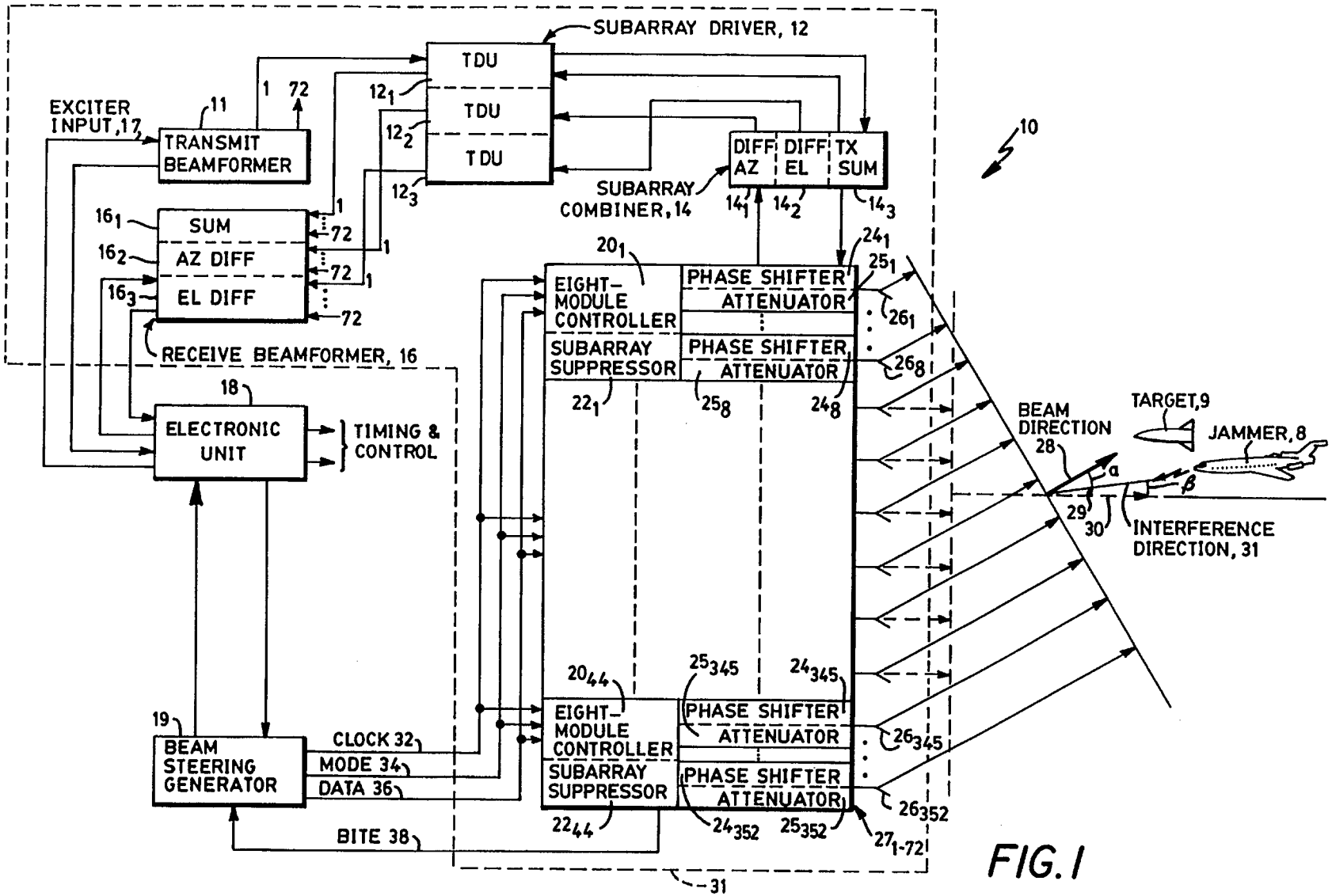
FIG. 1 is a simplified block diagram of a phased array radar system embodying the invention of a subarray interference suppressor in a plurality of module controllers which provide phase shift and attenuation commands for each element of a phased array antenna.
Figure 4:
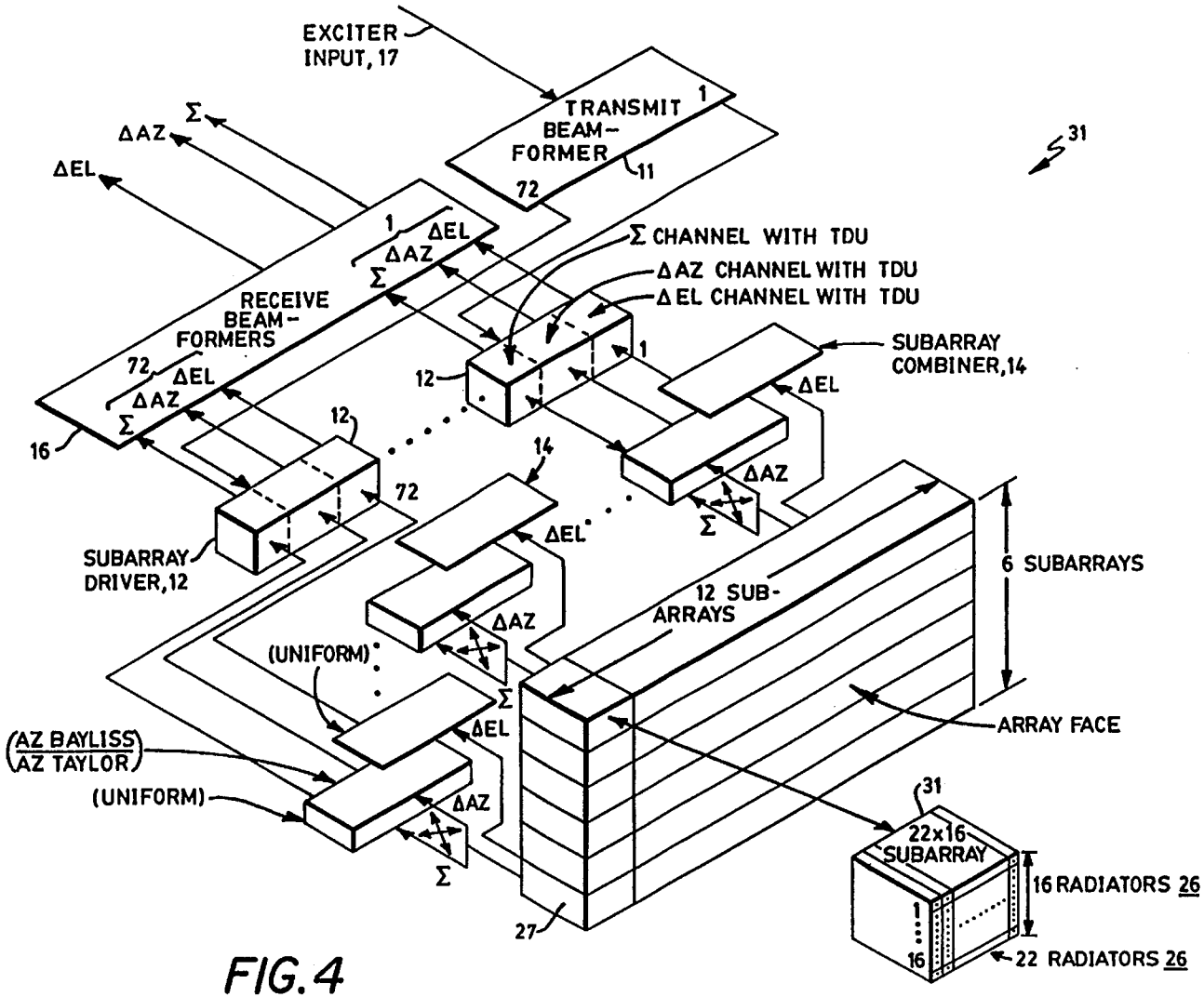
FIG. 4 is a perspective block diagram of a phased array radar antenna which includes the invention.

Referring to FIG. 1, there is shown a phased array radar system 10 having a monopulse phased array antenna 31 comprising a plurality of subarrays $\mathbf{27}_{1-72}$ with each subarray comprising 352 radiating elements $\mathbf{26}_{1-352}$ which are coupled to corresponding phase shifters $\mathbf{24}_{1-352}$ and attenuators $\mathbf{25}_{1-352}$. The phase shifters 24 and attenuators 25 are controlled by eight-module controllers $\mathbf{20}_{1-40}$ whereby each eight-module controller 20 provides command words for eight phase shifters 24 and eight attenuators 25. Each eight-module controller 20 comprises the invention of a subarray interference suppressor $\mathbf{22}_{1-44}$ for providing sum channel notching and simultaneous difference channel notching without difference null degradation by applying complex weights (phase shift and attenuation) at the subarray level consistent with notching the desired angular coverage on the subarray patterns. The same or identical subarray notching weights of phase shift and attenuation for one subarray are applied to each of the 72 subarrays, and the outputs of all time-steering subarrays in the total array antenna 31 of the preferred embodiment shown in FIG. 4 are combined to produce a wideband notch in the direction of interference.

The eight-module controller 20 is a processor for performing calculations required to provide the command words for the eight phase shifters 24 and attenuators 25. The phase shift command for each particular radiating element 26 of the phased array antenna 31 is based on the direction of phase-steered beam of electromagnetic energy and the radiating element 26 location in the array antenna 31 as well as the control of a spatial distribution of electromagnetic energy of the antenna 31 such as notching for suppressing interference. The attenuation command for each particular radiating element 26 of the phased array antenna is based on the control of a spatial distribution of electromagnetic energy of the antenna 31 such as notching for suppressing interference.

Still referring to FIG. 1, a source of electromagnetic energy is provided to a transmit beamformer 11, and it is coupled to a subarray driver 12 for time-steering a direction of a corresponding beam of electromagnetic energy of the antenna 31 being transmitted and received by the subarray 27. Electromagnetic energy is distributed by a subarray combiner 14 through the phase shifters 24 for determining the direction of the energy beam 28 and through the attenuators 25 and phase shifters 24 for controlling spatial distribution of the energy beam 28 such as notching emitted from the phased array antenna 31. Radar return signals are provided to the subarray combiner 14 and then coupled to the subarray driver 12 for combining outputs of attenuators 25 and phase shifters 24 in each subarray 27 to produce a phase-steered beam emitted from the subarray 27 with an identical notch in the direction of interference for each subarray 27. They are then sent to the receive beamformer 16 for combining outputs of the subarray drivers 12, to produce a wideband steered beam emitted from the antenna with a wideband notch in the direction of the interference. An electronic unit 18 provides an exciter input 17 and timing and control signals for the complete radar phased array antenna system 10. A beam steering generator 19 performs the data processing of the radar data and performs built-in test (BITE) or self-test capability for aiding in diagnostics and fault isolation of the eight-module controllers 20. The beam steering generator 19 provides initialization data comprising algorithm constants to each of the eight-module controllers 20. Three serial control lines, clock 32, mode 34 and data 36, are coupled from the beam steering generator 19 to the eight-module controllers 20, and a serial BITE line is coupled from the eight-module controllers 19 to the beam steering generator 19. Three serial control lines enable the eight-module controllers 20 to be communicated with individually or all controllers 20 simultaneously.

Figure 2:
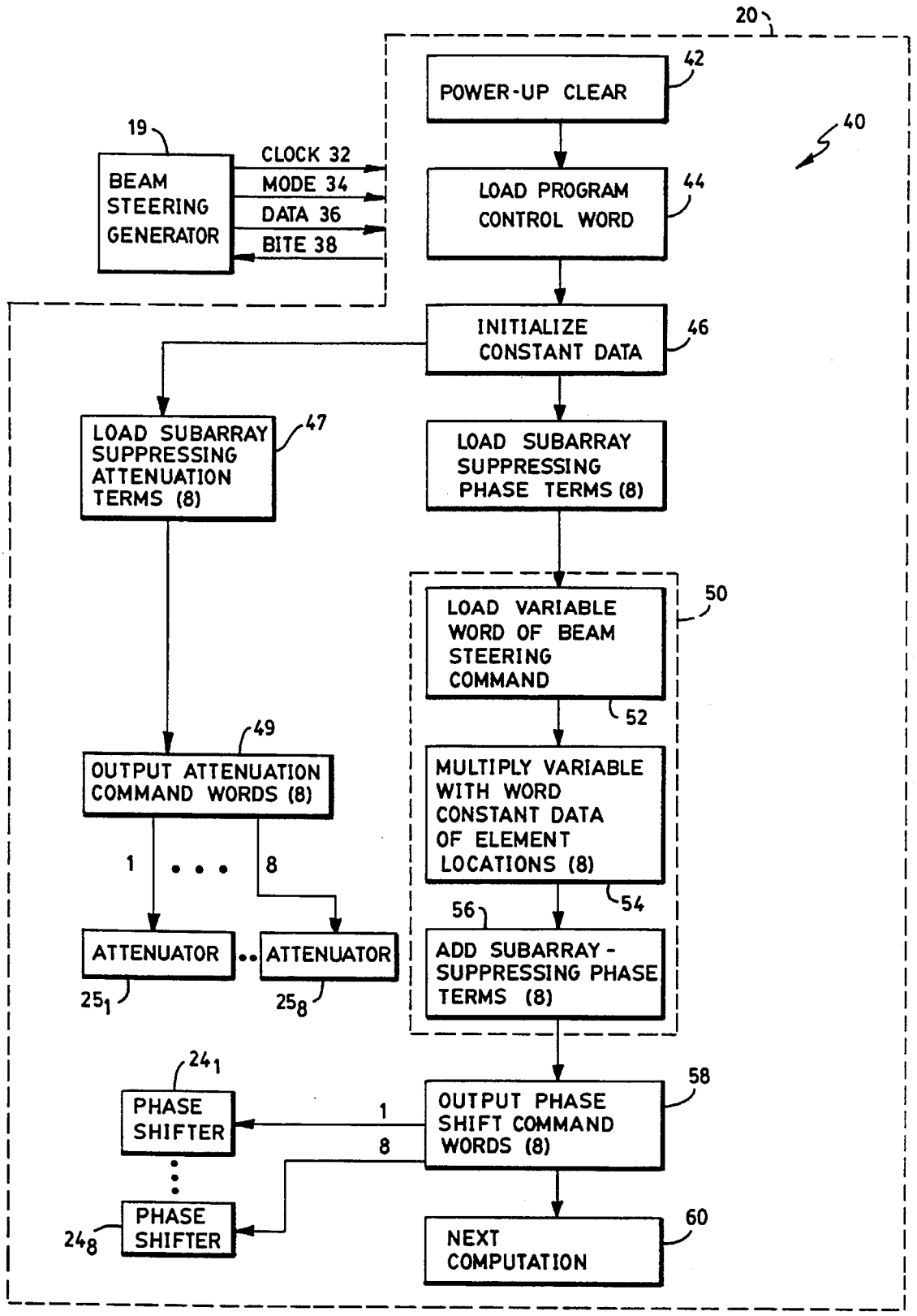
FIG. 2 is a flow chart of a subarray interference suppressor routine for generating the phase shift and attenuation commands for each element of the phased array antenna.
Figure 3:
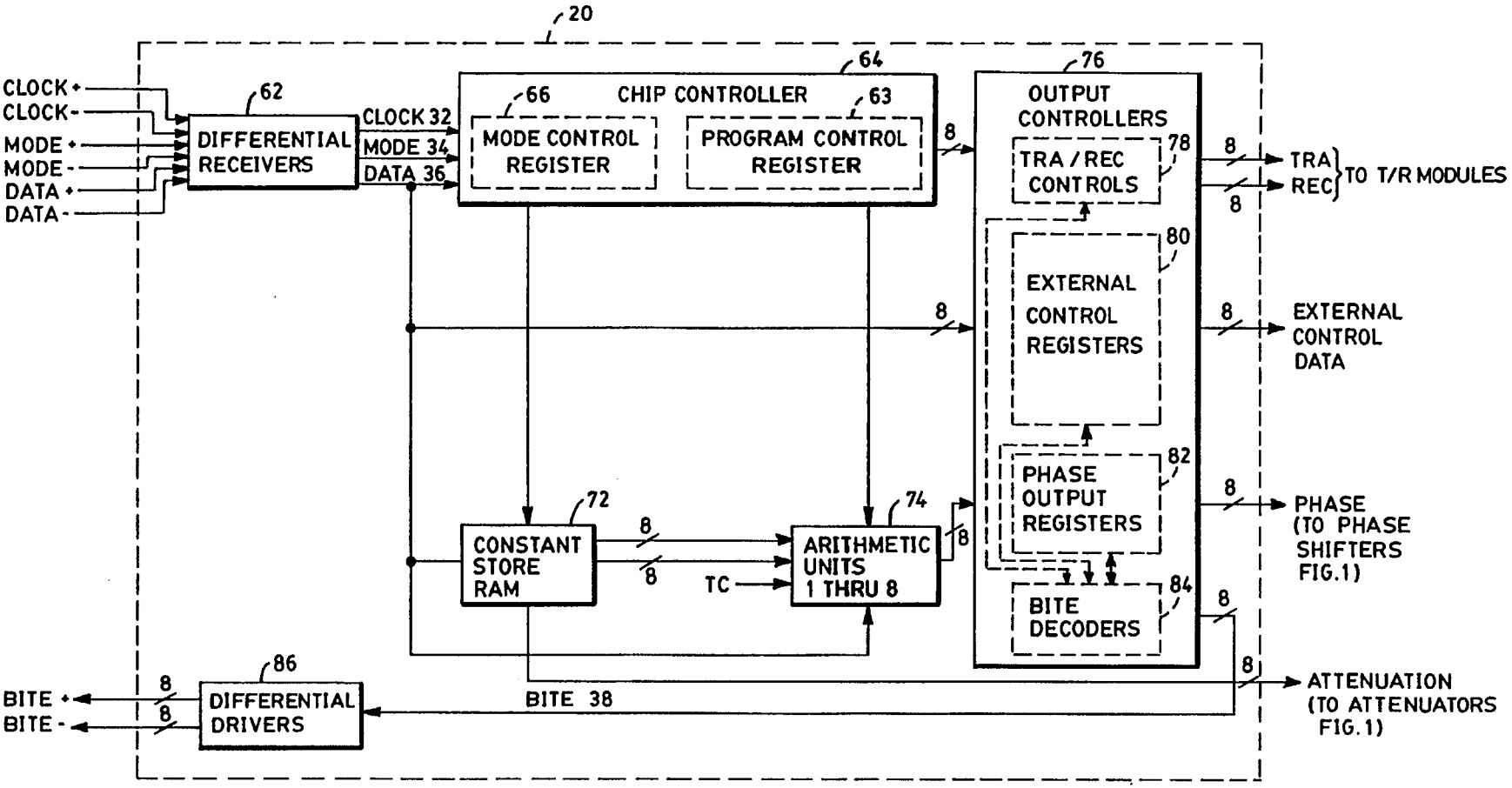
FIG. 3 is a block diagram of an eight-module controller embodying a subarray interference suppressor for suppressing wideband interference.

Referring now to FIG. 2 and FIG. 3, FIG. 2 is a flow chart of the present invention of a wideband interference 33 suppressor for generating the phase shift and attenuation command words for each radiating element 26 of the phased array subarrays 27. FIG. 3 is a block diagram of the eight-module controller 20 embodying the interference suppressor routine 40. The interference suppressor routine 40 operates on data received from the beam steering generator 19 which is stored in a RAM 72 of the eight-module controller 20. The interference suppressor routine 40 is also located in RAM 72, and the purpose of this routine is to generate the attenuation command words 49 and phase shift command words 58 in accordance with predetermined subarray weightings, the identical set of subarray weightings being applied to all subarrays 27.

Referring to FIG. 2, when power-up 42 occurs, a clear signal is generated which clears all registers and the RAM 72 in the module controller 20. Next, a load program control word is loaded into the eight-module controller 20 and stored in RAM 72. Then initialize constant data 46 operation occurs which loads constant data of the array geometry and element locations from the beam steering generator 19 into the RAM 72. Next, a load subarray suppressing phase shift terms 48 occurs which provides a predetermined subarray element-level phase shift consistent with notching the desired angular coverage on the subarray pattern itself. These subarray suppressing phase shift terms are applied repeatedly to the elements of each subarray in the total array; such subarray suppressing phase shift terms are stored in RAM 72. Next, a compute phase shift command word 50 operation is performed which performs the operation of load variable word of beam steering command 52, multiply variable word with constant data of element locations and add subarray suppressing phase terms 56. Eight computed phase shift command words ($\phi_{MN}$) are then forwarded to eight phase shifters 24 in the subarrays 27.

The initialize constant data 46 step also includes loading subarray suppressing attenuation terms 47 which provides a predetermined subarray element-level attenuation consistent with notching the desired angular coverage on the subarray pattern itself. These subarray suppressing attenuation terms are applied repeatedly to the elements of each subarray in the total array; such subarray suppressing attenuation terms are stored in RAM 72. Eight output attenuation command words 49 are then forwarded to eight of the attenuators 25 in the subarrays 27. The routine 40 proceeds with the computation in parallel of each eight antenna radiating elements 26 in the total array to complete these operations simultaneously.

Referring again to FIG. 3, the eight-module controller 20 is implemented with 0.9μ CMOS technology at the Raytheon Company Microelectronic Center, in Andover, Mass. on a standard 275 mil square sea-of-gates die. Differential receivers 62 receive the differential forms of the three serial control signals clock 32, mode 34 and data 36 and provide these signals to a chip controller 64. The chip controller 64 converts the serial mode 34 and data 36 signals into parallel control words for use by other portions of the eight-module controller 20. A program control register 63 within the chip controller 64 stores a 20-bit program control word which determines the terms and variable word length used for a phase shift algorithm and defines the current BITE mode. A mode control register 66 stores the mode word received from the beam steering generator 19 and the mode word is decoded and used both in a direct form and in a pulsed form to provide required mode control.

The random access memory (RAM) 72 receives data from the serial data 36 input under the control of the chip controller 64. The RAM 72 stores the constants for each element location, beam steering command data and the interference suppressor routine 40.

The arithmetic unit 74 comprises eight arithmetic units, each arithmetic unit includes a 17-bit serial multiplier and serial adder (not shown but known to one skilled in the art) which forms partial product terms and subsequently a full product term. The product term size is that of a BAMS (Binary Angular Measurement System) variable. The full product term is added to other accumulated terms of the phase-shift algorithm using the 17-bit serial adder within the arithmetic unit 74. Any negative constant term is taken care of by including a 2's compliment adjustment at the input to the serial adder. The final accumulated result is truncated to eight most significant fractional bits (MSBs) for parallel output to an output controller 76.

If it is desired in a specific application to compensate for temperature variations at each element of the array antenna 27, a temperature correction (TC) factor for the phase shift algorithm may be generated from an ambient temperature measurement made by a thermal sensor and fed into the eight-module controller 20. The temperature correction (TC) factor would be fed to the serial adder input of the arithmetic unit 54 where it may be added into the sum of products in the beam steering calculation producing a phase output which has been corrected for temperature at the antenna element location.

Still referring to FIG. 3, the eight MSBs of the phase-shift calculated in the arithmetic unit 74 are transferred to an output controller 76 where they are loaded into an 8-bit phase output register 82. In a bit wiggle mode of operation a phase value can be loaded directly from the input data 36 line and then transferred to the phase output register 82. The output controller 76 comprises a 16-bit external control register which is loaded directly from the data 36 input and it is used to store external control words. Transmit (TRA) and receive (REC) control signals are derived from a decoded TRA/REC mode signal fed to a TRA/REC controls 78 in the output controller 76. The TRA and REC control signals are used to switch monolithic microwave integrated circuit (MMIC) devices and subsequently control the transmit/receive duty cycles.

The output controller 76 also comprises a built-in test (BITE) decoder 84. A BITE code ($B_2B_1B_0$) of the program control word is decoded and used to select one of four BITE return modes comprising data rebound BITE, external control BIT, parallel output BITE (PARBITE) and TRA/REC control BITE. In a data rebound mode, data sent by the chip controller 64 is automatically returned on the BITE 38 line to confirm correct reception by the eight-module controller 20. The external control BITE mode allows any data stored in the 16-bit external control register (ECR) 80 to be transferred serially to the BITE 38 line. In the parallel output BITE (PARBITE) mode any phase value stored in the phase output register 82 can be clocked-out serially onto the BITE 38 line by first transferring the 8-bit value to the eight least significant bit (LSB) positions of the external control register 80. The T/R control BITE mode verifies that the distributed controller 20 has been placed in the transmit mode or receive mode. The logic-OR of the transmit (TRA) or receive (REC) control signals is placed on the BITE 38 line for verification. The BITE 38 line is connected to a differential driver 86 for transferring BITE data to the beam steering generator 19. The beam steering generator 19 sets up each distributed controller 20 into the BITE mode and tests the data sent back over the BITE 38 line.

Referring now to FIG. 4, a perspective block diagram of the monopulse phased array radar antenna 31 which includes the invention is shown. The antenna 31 comprises seventy-two (72) subarrays 27 arranged in a 12×6 matrix, and each subarray 27 comprises 352 radiating elements 26 as shown in FIG. 1. Coupled to each subarray is a subarray combiner 14 for providing an azimuth difference beam (ΔAz), an elevation difference beam (ΔE1) and a sum beam (Σ) for precision tracking of monopulse operation. The subarray combiner 14 of a sum beam combines uniformly for each subarray the outputs of the elements with Taylor weightings to produce a Taylor-weighted sum beam for normal mode of antenna operation or notch weightings to produce a notched sum beam for an interference suppressor mode of antenna operation. The subarray combiners 14 of an azimuth difference (or elevation difference) beam uses a Bayliss/Taylor non-uniform combiner to combine the outputs of the elements with the same Taylor weightings to produce a Bayliss weighted difference beam for normal mode of antenna operation or notch weightings to produce a notched difference beam for interference suppression for each subarray. Coupled to the combiners 14 are subarray drivers 12 which comprise a three section time delay unit (TDU) with time delay controls for ΣAz, ΣE1 and Σ for time-steering a direction of a corresponding beam of electromagnetic energy of the antenna for wideband monopulse operation. The subarray drivers 12 are coupled to three monopulse receive beamformer 16 and a transmit beamformer 11. Three monopulse receive beamformers combine uniformly the corresponding TDU outputs of seventy-two subarray drivers 12 to simultaneously form the azimuth difference beam, the elevation difference beam and the sum beam with a wideband notch in the direction of interference. The transmit beamformer 11 distributes uniformly seventy-two outputs to the subarray driver 12 for forming the uniformly weighted transmit beam for the maximum efficiency of a T/R module.

The ΔAz, ΔE1 and Σ outputs from the receive beamformers 16 are coupled to the electron unit 18 for further processing, and exciter input 17 from the electronic unit 18 is fed to the transmit beamformer 11. There are seventy-two outputs from the transmit beamformer 11, one for each subarray and each are coupled to one of the 72 subarray drivers 12.

Figure 5:
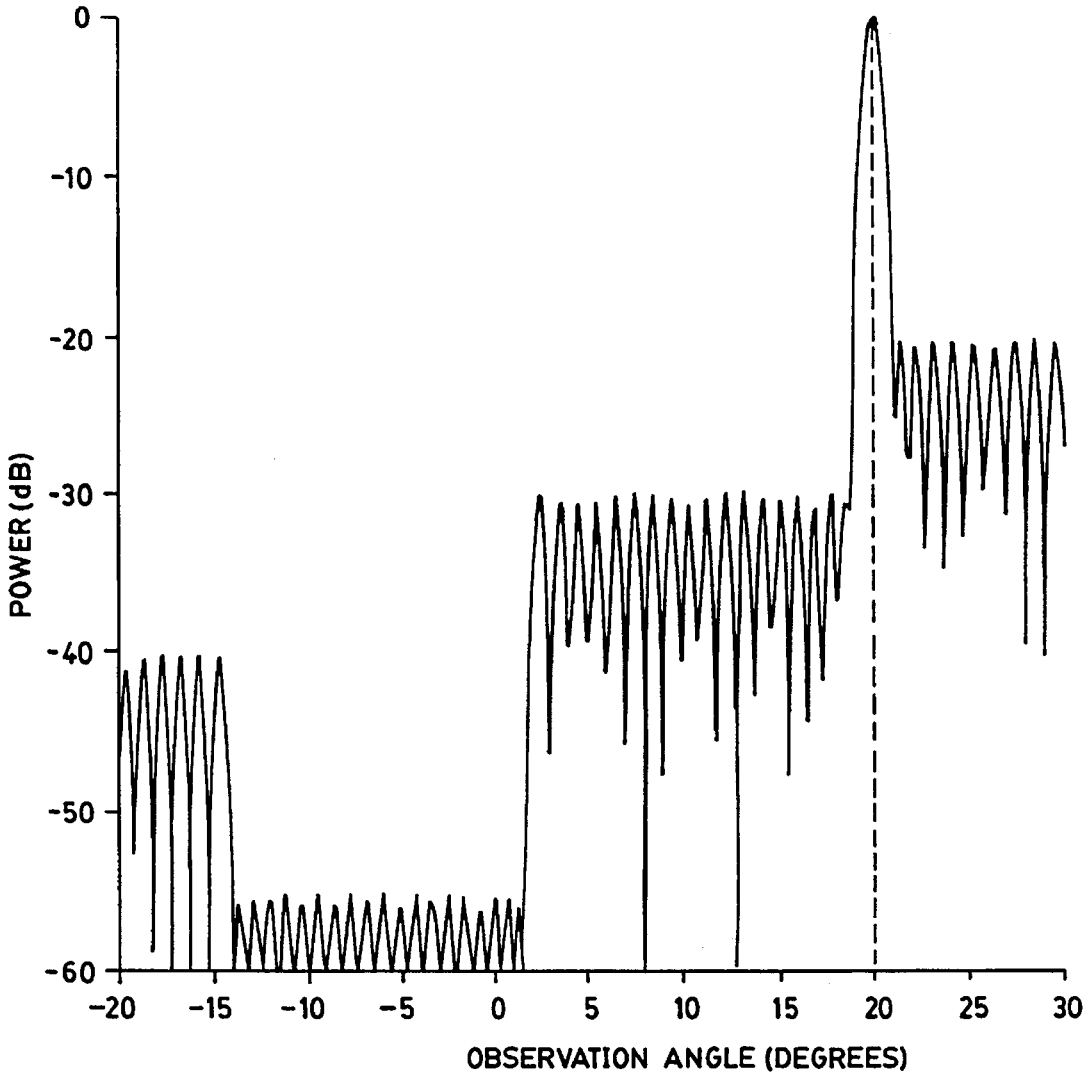
FIG. 5 (PRIOR ART)
FIG. 5 shows a graph of a narrowband notched pattern using a conventional algorithm of the prior art full-aperture interference suppressor at 20° array scan in elevation (designed to have −55 dB notch unit).
Figure 6:
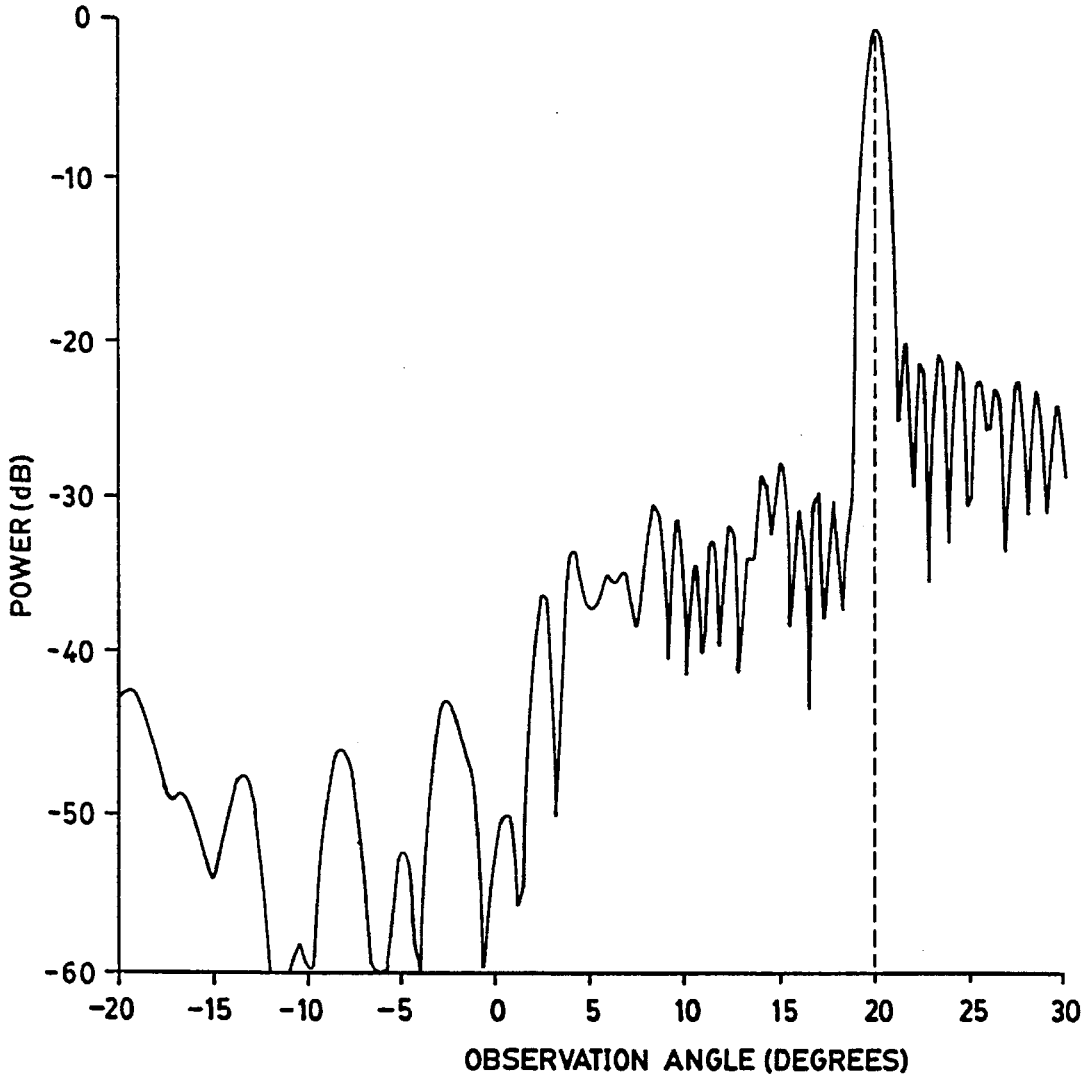
FIG. 6 (PRIOR ART)
FIG. 6 shows a graph of a degraded wideband notched pattern averaged over the full bandwidth at 20° array scan in elevation which results in accordance with the conventional algorithm of the prior art full-aperture interference suppressor.

Referring now to FIG. 5, and FIG. 6, FIG. 5 shows a graph of an array pattern without notching comprising a 30 dB Taylor sum beam and a 30 dB Bayliss difference beam. These beams result from the beamformers architecture shown in FIG. 4 without using the present invention of the subarray interference suppressor. FIG. 6 shows a graph of a full aperture notched monopulse array pattern having a difference beam that is significantly degraded as indicated by the 303 microradians of null squinting.

Figure 7:
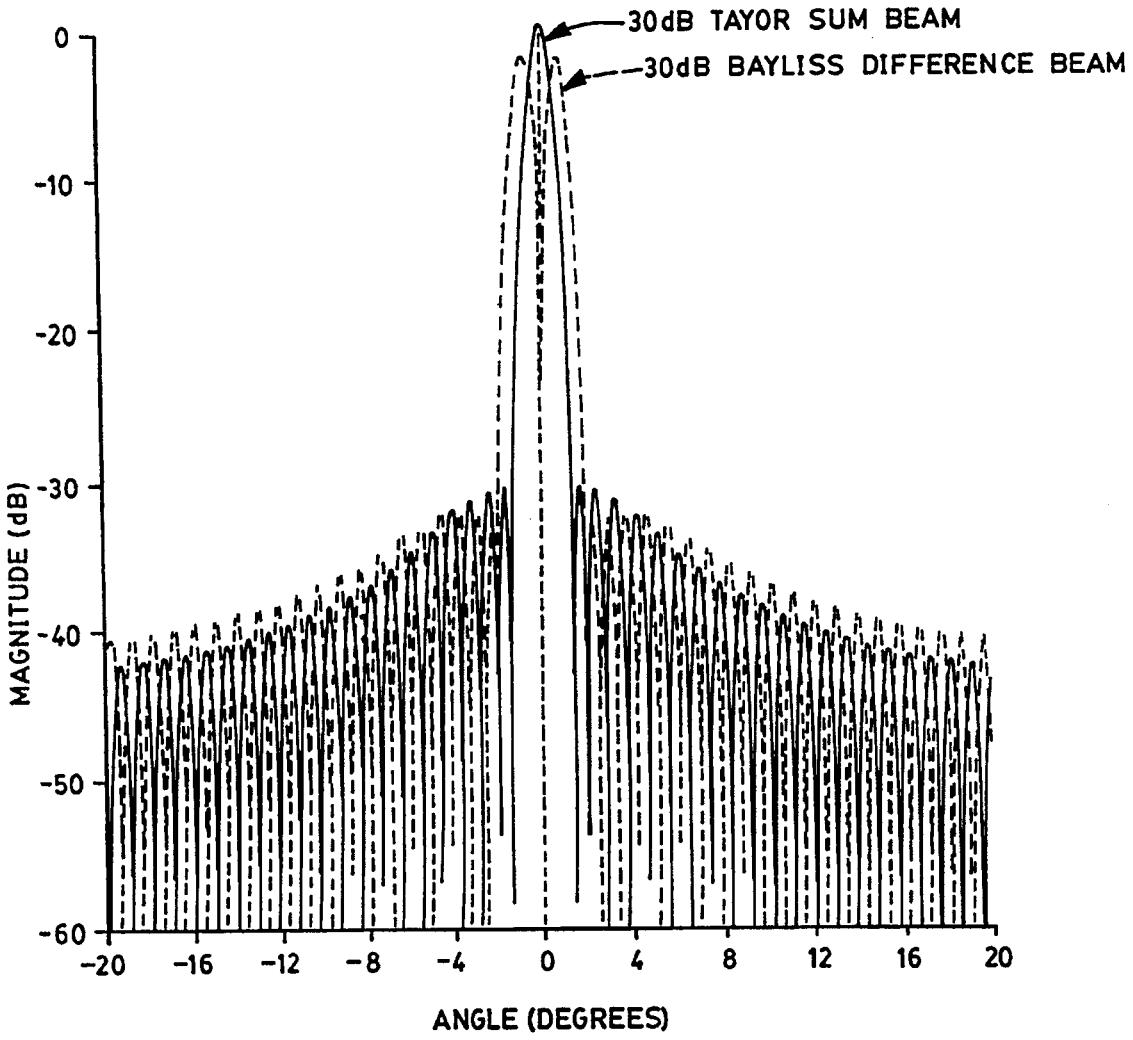
FIG. 7 (PRIOR ART)
FIG. 7 shows a graph of a monopulse array pattern without notching for interference suppression comprising a Taylor sum beam and a Bayliss difference beam.
Figure 8:
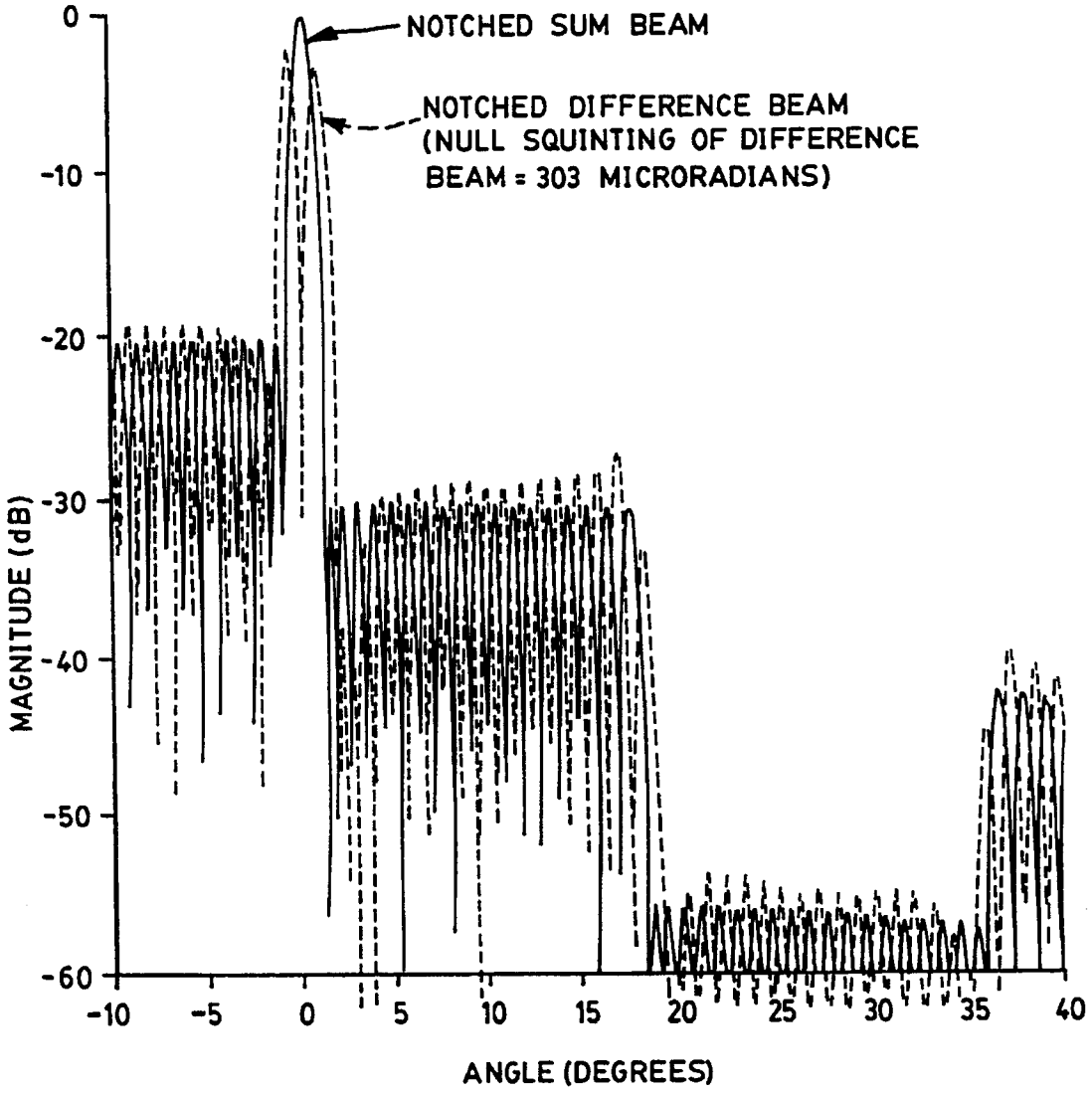
FIG. 8 (PRIOR ART)
FIG. 8 shows a graph of a prior art full-aperture notched monopulse array pattern having a difference beam that is significantly degraded.
Figure 9:
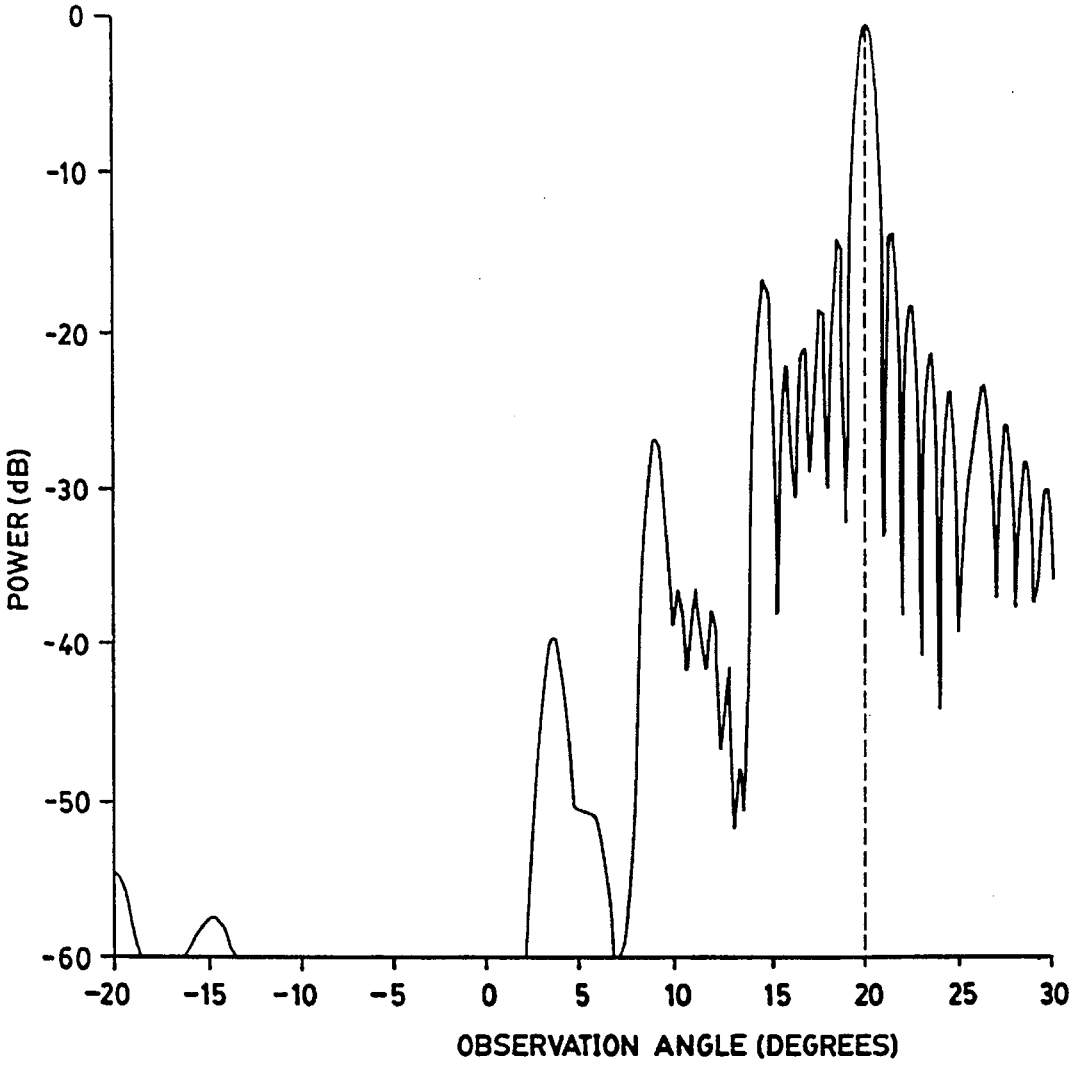
FIG. 9 shows a graph of a wideband notched pattern averaged over the full bandwidth at 20° array scan in elevation which results in accordance with the invention of a subarray interference suppressor.
Figure 10:
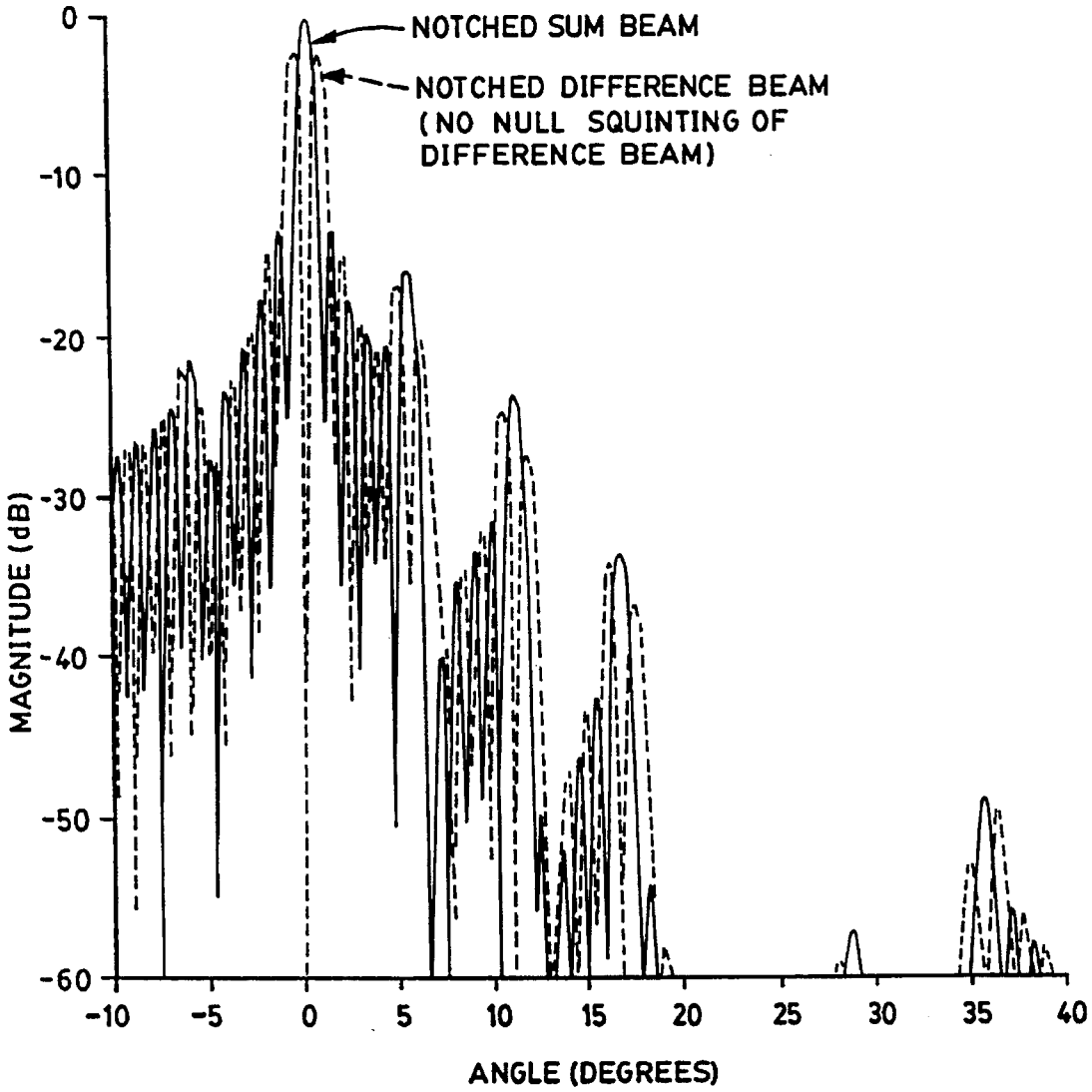
FIG. 10 shows a graph of notched monopulse patterns with no null squinting of the difference beam resulting from the invention of a subarray interference suppressor.

Referring now to FIG. 7, and FIG. 8, FIG. 7 shows a graph of a wideband notched pattern using the present subarray interference suppressor invention averaged over the full bandwidth at 20° array scan in elevation. FIG. 8 shows a graph of notched monopulse patterns having a notched sum beam and a notched difference beam resulting from the phased array antenna 31 of FIG. 1 and FIG. 4 employing the present invention. The notched difference beam shows no null squinting. The generation of the predetermined attenuations and phase shifts for the elements of a phased array antenna 31 are well known in the art and described in the paper by H. J. Orchard, R. S. Elliott and G. J. Stern, "Optimizing the Synthesis of Shaped Beam Antenna Patterns," published in IEEE Proceedings (London), Pt. H., 1 (1985), pp. 63–68. The subarray suppressing phase shift and attenuation loads are obtained using Orchard's pattern synthesis to produce the notch consistent with the desired angular coverage on the subarray pattern itself. These subarray suppressing phase shift and attenuation words are subsequently applied to the elements of each subarray of the total array to produce the wideband notch antenna patterns.

This concludes the description of the preferred embodiment. However, many modifications and alterations will be obvious to one of ordinary skill in the art without departing from the spirit and scope of the inventive concept. For example, the number of radiating elements and subarrays along with associated electronics will vary depending on the particular application requirements. Therefore, it is intended that the scope of this invention be limited only by the appended claims.

What is claimed is:

1. A phased array antenna comprising:

a plurality of time-steering subarrays;

each of said subarrays comprises a plurality of interference suppressor means;

said interference suppressor means comprises means for generating a set of identical notch control commands for each of said time-steering subarrays;

subarray driver means coupled to each of said time-steering subarrays for combining outputs of said interference suppressor means to produce an identical notch for each of said subarrays in the direction of interference; and beamforming means coupled to said subarray driver means for combining outputs of said time-steering subarrays to produce a wideband notch of said antenna in the direction of interference.

2. The phased array antenna as recited in claim 1 wherein:

each of said time-steering subarrays comprises a plurality of radiating elements.

3. The phased array antenna as recited in claim 1 wherein:

each of said time-steering subarrays comprises a subarray combiner means for time-steering a direction of a corresponding beam of electromagnetic energy of said antenna for wideband operation.

4. The phased array antenna as recited in claim 1 wherein:

said means for generating a set of identical notch control commands comprises means for storing a predetermined set of subarray notch weightings.

5. The phased array antenna as recited in claim 4 wherein:

each of said subarray notch weightings comprises a phase shift term and an attenuation term.

6. The phased array antenna as recited in claim 1 wherein said interference suppressor means operates within a processing means coupled to phase shift means and attenuation means for each radiating element of said subarrays.

7. A phased array antenna having wideband interference suppression comprising:

a plurality of subarrays, each of said subarrays comprises a plurality of radiating elements;

subarray combiner means coupled to each of said plurality of subarrays for providing an azimuth difference beam, an elevation difference beam and a sum beam for precision tracking of monopulse operation;

subarray driver means, including time delay unit means, coupled to said corresponding subarray combiner means, for time-steering a direction of a corresponding beam of electromagnetic energy of said antenna for wideband operation;

phase shift means coupled to each of said radiating elements for phase-steering said direction of said beam of electromagnetic energy and controlling a spatial distribution of said electromagnetic energy of said antenna;

attenuation means coupled to each of said phase shift means for adjusting the gain of each of said plurality of radiating elements and controlling said spatial distribution of said electromagnetic energy of said antenna;

processing means coupled to said phase shift means and said attenuation means for providing an interference suppressor means for said radiating elements of said subarrays;

said processing means comprises means for storing a predetermined set of subarray notch weightings, said predetermined set of subarray notch weightings being identical for each subarray;

said interference suppressor means comprises means for generating a phase shift command and an attenuation command for each of said radiating elements in accordance with said subarray notch weightings;

said time delay unit means comprises means for combining outputs of said subarray radiating elements in accordance with said phase shift command and said attenuation command to produce said spatial distribution of said electromagnetic energy of each of said subarrays having an identical notch in the direction of interference for each of said subarrays; and beamforming means coupled to said time delay unit means for combining outputs of said subarray driver means, each of said subarrays producing said identical notch in the direction of interference, and for producing said spatial distribution of said electromagnetic energy of said antenna having a wideband notch in the direction of interference.

8. The phased array antenna as recited in claim 7 wherein each of said subarray notch weightings comprises a phase shift term and an attenuation term.

9. The phased array antenna as recited in claim 7 wherein said subarray driver means comprises a time delay unit for each of said azimuth difference beam, said elevation difference beam and said sum beam.

10. The phased array antenna as recited in claim 7 wherein:

said processing means comprises an output controller for generating transmit and receive control signals, providing external control data, storing said phase shift command and attenuation command outputs, and providing BITE operations.

11. A method for providing wideband interference suppression in a phased array antenna comprising the steps of:

providing a plurality of time-steering subarrays;

providing a plurality of interference suppressor means for said subarrays;

generating a set of identical notch control commands for each of said subarrays with said interference suppressor means;

combining outputs of said interference suppressor means with subarray driver means coupled to each of said time-steering subarrays to produce an identical notch for each of said subarrays; and combining outputs of said time-steering subarrays to produce a wideband notch of said antenna in the direction of interference beamforming means coupled to said subarray driver means.

12. The method as recited in claim 11 wherein:

said step of providing a plurality of time-steering subarrays comprises the step of each of said time-steering subarrays having a plurality of radiating elements.

13. The method as recited in claim 11 wherein:

said step of providing said time-steering subarrays comprises the step of providing a subarray combiner means for time-steering a direction of a corresponding beam of electromagnetic energy of said antenna for wideband operation.

14. The method as recited in claim 11 wherein:

said step of generating a set of identical notch control commands comprises the step of storing a predetermined set of subarray notch weightings.

15. The method as recited in claim 14 wherein:

said step of storing said predetermined set of said subarray notch weightings comprises the step of storing a phase shift term and an attenuation term for each of said notch weightings.

16. A method for providing wideband interference suppression in a phased array antenna comprising the steps of:

providing a plurality of subarrays, each of said subarrays comprises a plurality of radiating elements;

providing an azimuth difference beam, an elevation difference beam and a sum beam for precision tracking of monopulse operation with subarray combiner means coupled to each of said plurality of subarrays;

time-steering a direction of a corresponding beam of electromagnetic energy of said antenna for wideband operation with subarray driver means, including time delay unit means, coupled to said corresponding subarray combiner means;

phase-steering said direction of said beam of electromagnetic energy and controlling a spatial distribution of electromagnetic energy of said phased array antenna with phase shift means coupled to each of said plurality of radiating elements;

adjusting the gain of each of said plurality of radiating elements and controlling said spatial distribution of said electromagnetic energy of said antenna with attenuation means coupled to each of said phase shifter means;

providing an interference suppressor means for said subarray radiating elements with processing means coupled to said phase shift means and said attenuation means;

storing a predetermined set of subarray notch weightings in said processing means, said predetermined set of subarray notch weightings being identical for each subarray;

generating a phase shift command and an attenuation command for each of said subarray radiating elements in said interference suppressor means in accordance with said subarray notch weightings;

combining outputs of said subarray radiating elements with said time delay unit means in accordance with said phase shift command and said attenuation command to produce said spatial distribution of said electromagnetic energy of each of said subarrays having an identical notch in the direction of interference for each of said subarrays; and combining outputs of said subarray driver means with beamforming means coupled to said time delay unit means to produce said spatial distribution of said electromagnetic energy of said antenna having a wideband notch in the direction of interference with beamforming means coupled to said time delay unit means.

17. The method as recited in claim 16 wherein said step of storing said predetermined set of said subarray notch weightings comprises the step of storing a phase shift term and an attenuation term for each of said weightings.

18. The method as recited in claim 16 wherein said step of combining outputs of said subarray radiating elements comprises the step of providing a subarray coupled to each of said plurality of subarrays for providing an azimuth difference beam, an elevation difference beam and a sum beam.

19. The method as recited in claim 16 wherein said step of time-steering a direction of a corresponding beam of electromagnetic energy of said antenna for wideband operation with subarray driver means comprises the step of providing a time delay unit for each of said azimuth difference beam, said elevation difference beam and said sum beam.

20. The method as recited in claim 16 wherein said step of providing said processing means comprises the step of said processing means having an output controller for generating transmit and receive signals, providing external control data, storing a phase shift and attenuation command word outputs, and providing BITE operations.

* * * * *